United States Patent [19]

Pronovost et al.

[11] Patent Number: 5,072,531

[45] Date of Patent: Dec. 17, 1991

[54] GROUND SHOE FOR SNOW BLOWING VEHICLE

[76] Inventors: Normand Pronovost; Réjean Pronovost, both of 260, Route 159, St-Tite, Québec, Canada, G0X 3H0

[21] Appl. No.: 625,758

[22] Filed: Dec. 11, 1990

[51] Int. Cl.[5] ..... E01H 5/07

[52] U.S. Cl. ..... 37/256; 37/271; 37/248; 172/393

[58] Field of Search ..... 37/244, 263, 270, 271, 37/248, 249, 253, 254. 255, 256; 172/188, 393, 783; 280/845, 12.13, 12.14

[56] References Cited

U.S. PATENT DOCUMENTS

| | | | |
|---|---|---|---|
| 1,687,169 | 10/1928 | Marran | 37/271 |
| 2,108,541 | 2/1938 | Lull | 172/783 |
| 2,166,667 | 7/1939 | Watkins | 37/248 X |
| 2,315,007 | 3/1943 | Morse et al. | 37/256 |
| 2,403,219 | 7/1946 | Hanson et al. | 37/270 |
| 2,787,064 | 4/1957 | Schiller | 37/270 X |
| 3,562,933 | 2/1971 | Hanneman et al. | 37/248 |

FOREIGN PATENT DOCUMENTS

| | | | |
|---|---|---|---|
| 508167 | 6/1953 | Belgium | 37/270 |
| 33753 | 9/1964 | Finland | 37/270 |
| 604920 | 4/1978 | U.S.S.R. | 172/393 |

*Primary Examiner*—Randolph A. Reese
*Assistant Examiner*—Arlen L. Olsen

[57] ABSTRACT

A pair of road-sliding skates for mounting onto a front-loaded, snowplow, automotive vehicle are provided, to prevent damage to the structural integrity of the vehicle when rolling on a high-crowned road, yet enabling unhampered snowblowing operation of the snowplow in high snow banks. The skates are mounted rearwardly of the front bucket side walls of the vehicle, being substantially inwardly offset relative to the vertical plane of the corresponding side walls, yet being forwardly positioned relative to the front leading edge of the recessed bucket flooring. Each skate position is adjusted about a horizontal, fore and aft axis as well as in elevation.

3 Claims, 2 Drawing Sheets

GROUND SHOE FOR SNOW BLOWING VEHICLE

FIELD OF THE INVENTION

This invention relates to snow plows, and particularly to automotive vehicles with front-loaded, worm-screw carrying buckets for collecting ground snow and ice when rolling on a road and ejecting same laterally away from the road through a chute.

BACKGROUND OF THE INVENTION

Efficient operation of automotive snow plows in Canadian winters requires the snowplow to roll on snow-covered roads at relatively high speeds, while the worm-screw carrying, front-loaded bucket collects snow by the scraping of the road surface with the bucket flooring front leading edge. It is recognized in the field that high-crowned roads are very hazardous for the structural integrity of such snowplows, in that severe damage could occur from impact following the bucket flooring front leading edge striking a rigid transverse road projection. The vehicle can then be brutally stopped, thus sustaining a very heavy structural load.

Skates or snow shoes have been developed in the past to circumvent this problem, being installed beneath the bucket flooring so as to slightly raise the height of the bucket flooring wherein potholes, icepacks and the like on the road will impact the upturned front end of the skates (which will bias the bucket upwardly or at the most, would release the bucket yieldingly under an extreme load, but without any structural damage to the bucket per se) rather than the front leading edge of the bucket flooring. However, these known skates are not very efficient, in that a relatively high ground icepack or other raised projection on the road could still strike the bucket leading edge. On the other hand, by bringing the skates forward of the level of such bucket leading edge, by anchoring such skates laterally outwardly of the bucket opposite vertical side walls, the problem of the hitting of ground obstacles by the bucket leading edge may be resolved, but there is introduced a new problem. This new problem is the fact that these skates, by protruding laterally outwardly from the side walls of the snowplow bucket, will constitute obstacles during operation of the snowplow in snow banks of substantial height, which is to say, by frictionally engaging the snow bank walls defined by the snow-free channel opened frontwardly by the snowplow, the effective working speed of the vehicle will be reduced, and/or the bucket will forcibly break or yieldingly release under the load.

OBJECTS OF THE INVENTION

The gist of the invention is therefore to provide ground-sliding skates for the front-loaded worm-screw bucket of an automotive snowplow vehicle, which will prevent structural damage to the vehicle upon impact thereof of projections on a high-crowned road, while being adjustable in position in height and/or in a fore and aft direction.

An important object of the invention is that the abovenoted skates be positioned substantially interiorly of the planes of the corresponding vertical bucket side walls, so as not to hamper operative maneuvers of the snowplow in snow banks of substantial height.

A general object of the invention is to mount such a pair of skates to the front bucket of the snowplow vehicle, in such a way as to require very few if any modifications to the overall structure of the vehicle.

SUMMARY OF THE INVENTION

Accordingly with the objects of the invention, there is disclosed the combination of an automotive snowplow vehicle having a front, snow collecting bucket destined to collect snow and ice upon forward motion of the vehicle on a road, said vehicle destined to have means for further crushing snow and ice within said bucket, for gathering the crushed snow and ice and for discharging same laterally away from the road through a pivotable chute; said bucket defining a large, frontwardly opened casing having top, bottom, rear and side walls bounding a front mouth, and a pair of skate mount assemblies each mounted to a bottom, rear end section of a corresponding one of the two said side walls of the bucket casing; each said skate mount assembly defining a substantially horizontal skate member integrally mounted to said bucket and defining a smooth, substantially horizontal underface designed to frictionally engage said road, the front edge section of said skate member being upwardly-forwardly inclined, said bucket bottom wall or floor defining a front leading edge section being slightly rearwardly offset relative to the level of said skate member front edge section; each said skate mount assembly being positioned substantially interiorly of the vertical plane passing through the correponding bucket side wall.

Preferably, the inclination of said skate member front leading edge section is about 30° with respect to the horizontal axis, to ensure that the skate leading edge section will lift upon impact on a ground obstacle by the fore moving vehicle.

Advantageously, there is further provided adjustment means, for adjusting either of or both the height of said skate member relative to said bucket flooring and the fore and aft position of said skate member relative to said bucket flooring front leading edge section, concurrently or not. If done concurrently, forward adjustment of the skate member position would then be effected concurrently with downward adjustment of the height thereof, or rearward adjustment of the skate member position would be effected concurrently with upward adjustment of the height thereof.

It is envisioned that each said skate mount assembly further includes a frame member, integrally mounted to said corresponding bucket side wall, said frame member defining an open-ended, rearwardly-upwardly-inclined channel extending therethrough, a slider shaft slidably engaged into said channel and endwisely integrally carrying said skate member at its bottom end at an angle, and locking means to releasably fixedly secure said slider shaft to said frame member in a selected lengthwise position within said channel.

In such a case, said channel and said slider shaft are profitably cross-sectionally polygonal, said skate mount assembly defining a free rearward section clearing said bucket, and wherein said locking means includes: (a) a number of first teeth, upwardly projecting from the rearward section of said slider shaft; (b) a lever arm, pivotally mounted at its top end by a pivot ear to said skate mount frame, said pivot ear defining a pivotal axis parallel to said channel and a number of few second teeth, downwardly depending therefrom, wherein said lever arm is pivotable between a first operative position, in which said first and second teeth matingly engage one another thereby preventing sliding motion of said shaft within said channel, and a second inoperative position, in which said first and second teeth are clear from each other thereby enabling free sliding motion of said shaft through said channel. Said lever arm could preferably be vertical in its said operative position. Profitably, bracket means are provided, to releasably anchor said lever arm in its said operative position.

DETAILED DESCRIPTION OF THE INVENTION

Figure 1:
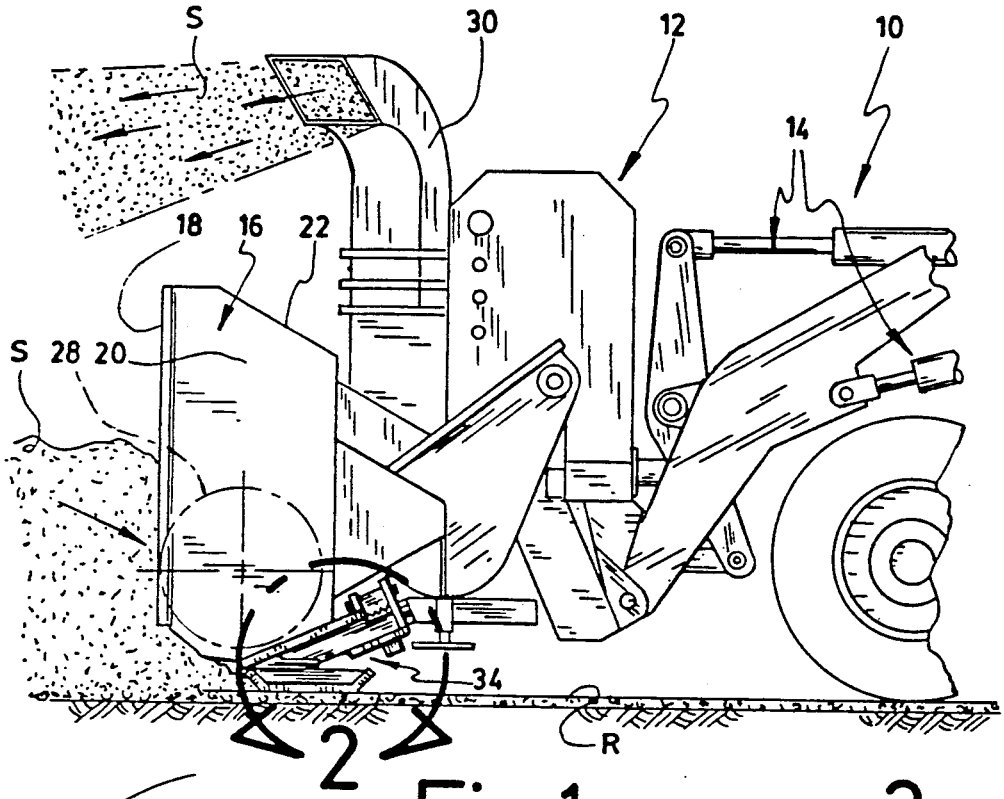
FIG. 1 is a side elevational view of a snow-collecting and discharging truck, illustrated in fragmentary view, in operation on a road.
Figure 2:
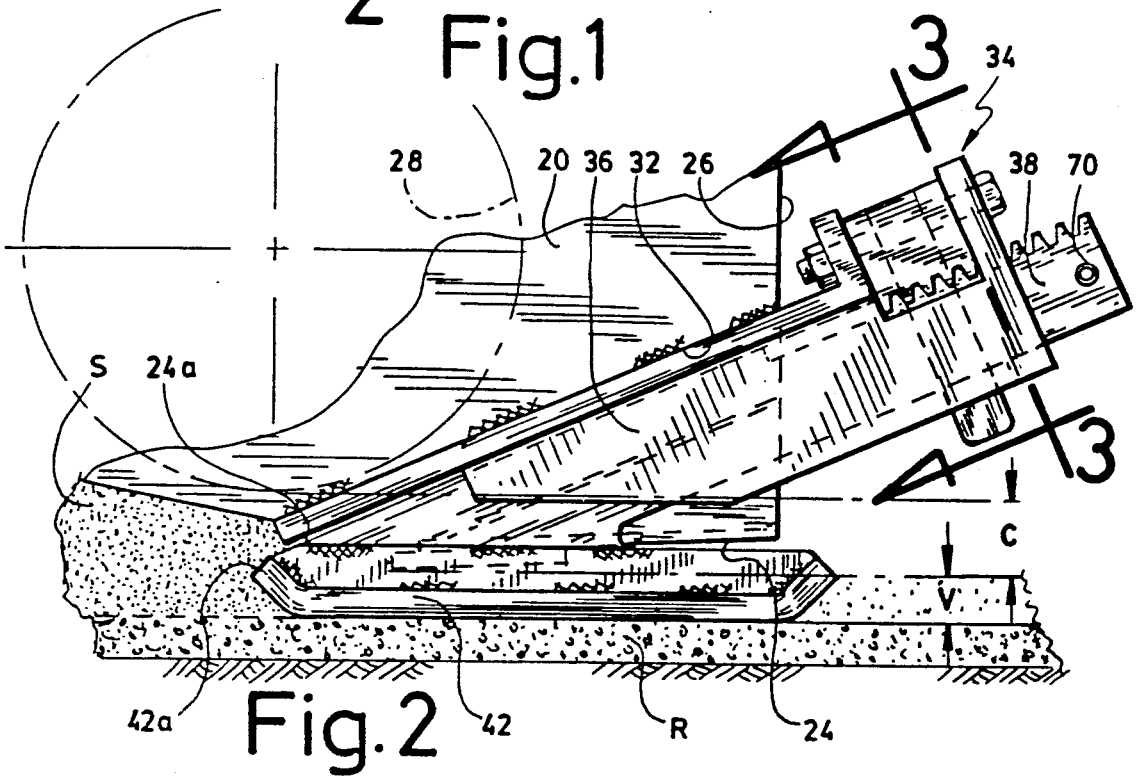
FIG. 2 is an enlarged view of the area circumscribed within circle 2 of FIG. 1.

The snowblower vehicle 10 illustrated in FIG. 1 is of the road-going, wheel-carried type, conventionally including a frontwardly-mounted, snow-collecting unit 12. The whole frame of unit 12 is movable in elevation, as well as in fore and aft and pitch axes, through hydraulic ram means 14 controlled by the driver of vehicle 10 from his cabin. The frontmost section of unit 12 includes a large frontwardly opened casing or bucket, 16, having a large, substantially vertical, generally quadrangular, front mouth 18 for engagement by ground snow S gathered on a road R during forward motion of vehicle 10.

Front-loaded bucket 16 defines two opposite, substantially vertical side walls 20, a top wall 22, a bottom wall or flooring 24 and a rear wall 26 coextensive with the top, bottom and side walls thereof. Flooring 24 defines a front, substantially horizontal, leading edge 24*a*, which may be rearwardly recessed relative to the corresponding front edges of the bucket side walls. A rigid worm screw 28 is rotatably carried by side walls 20 slightly above flooring 24, for grasping incoming snow and ice, for crushing same in small fragments and for carrying same towards a snow intake port (not shown) which upwardly escapes from the bucket. This crushed snow then engages a upturned channel and a coextensive arcuate chute 30 for forcible discharge laterally outwardly of the road through snow-blowing means. All of the above is conventional.

Figure 4:
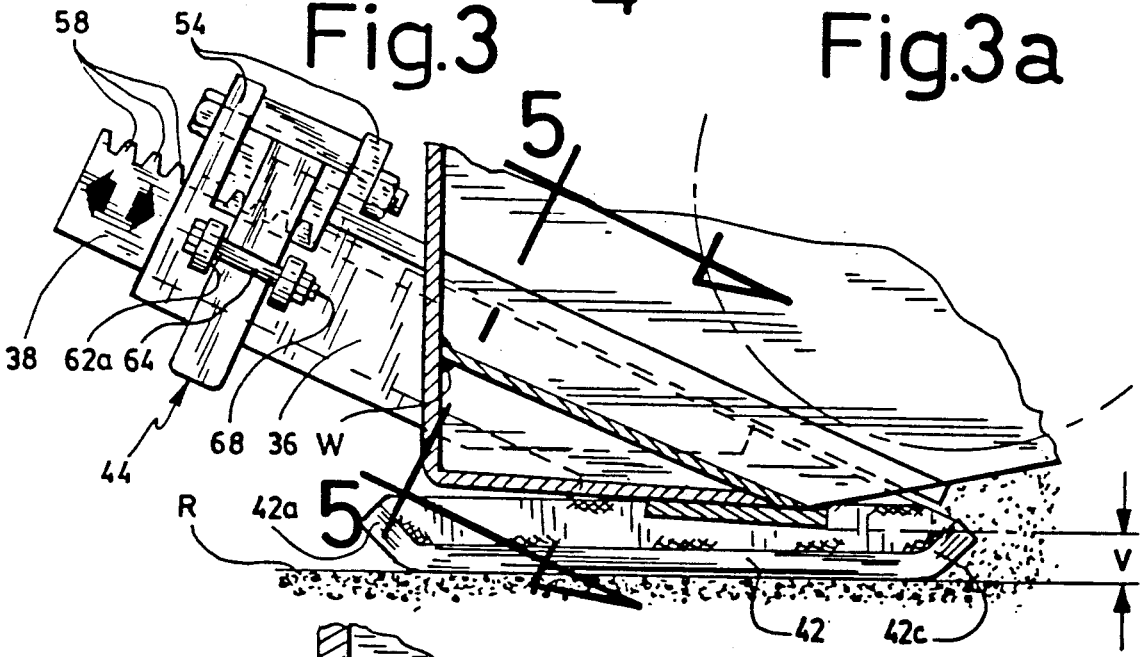
FIG. 4 is a sectional view along line 4—4 of FIG. 3.
Figure 5:
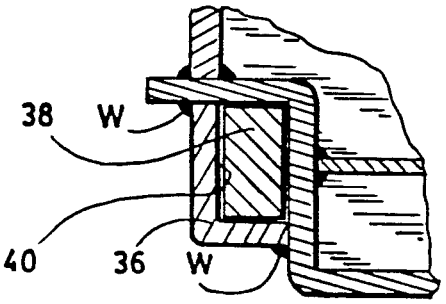
FIG. 5 is a cross-section about line 5—5 of FIG. 4.

In accordance with the teachings of the invention, the lower, rearward edge section of each side wall 24 of the bucket 16, is upwardly-rearwardly inclined, at 32, for receiving therein a snow shoe assembly 34. Assembly 34 includes:

(a) a main, box-like, rigid frame 36, integral to side wall 20 (e.g. by weld points W, see FIG. 5), and projecting rearwardly beyond the plane of rear wall 26;

(b) a slider shaft 38, carrying a rigid snow shoe or skate 42 at its bottom end;

(c) a rearwardly, upwardly-inclined, lengthwise channel 40 (FIG. 5) extending through frame 36 and freely, slidably engaged by the slider shaft 38 (see the arrows at the left side of FIG. 4), the shaft 38 projecting outwardly from the channel at both ends thereof; and (d) locking means 44, for releasably locking slider 38 at a selected slided position within channel 40 of frame 36.

Channel 40 and shaft 38 should be cross-sectionally polygonal, e.g. preferably quadrangular.

Shoe 42 consists of a sturdy, elongated, rigid plate having a smooth underface 42*b*, and with at least its front, leading edge section 42*a* being upwardly-forwardly inclined, e.g. by about 30°. Shoe plate 42 defines a lengthwise axis making a small, acute angle, e.g. 30°, with the integral slider shaft 38 engaged in channel 40. Shoe underface 42*b* is destined to frictionally slide against the pavement of a road.

Figure 3:
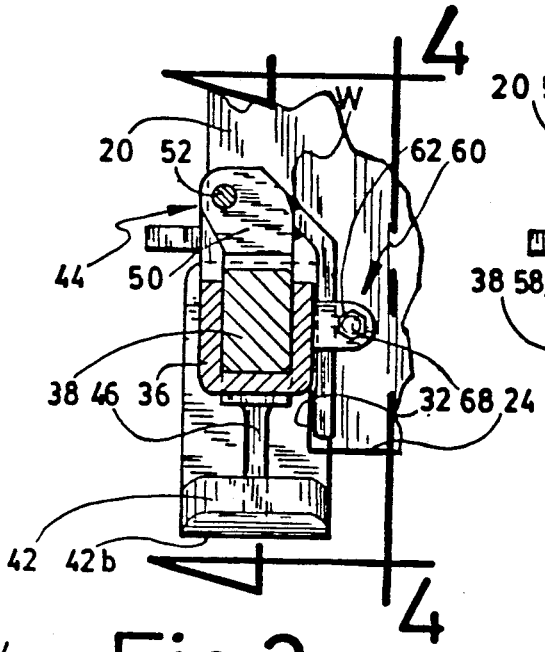
FIG. 3 is a slightly enlarged, cross-sectional view along line 3—3 of FIG. 2.
Figure 3A:
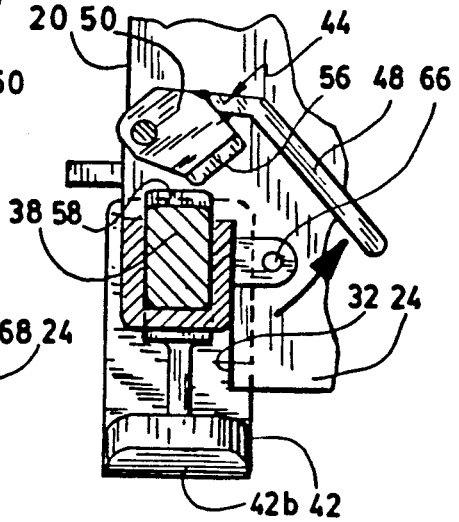
FIG. 3*a* is a view similar to FIG. 3 but with the latch in its shoe slider-disconnect position.

As clearly illustrated in FIGS. 3 and 3*a*, the main section of each frame 36 is lodged within the cross-sectionally L-shape cavity 32 so as not to protrude outwardly from the substantially vertical plane of the adjacent side wall 20. Shoe plate 42 is rigidly spacedly connected to frame 36, at an angle, by a transverse, vertical arm 46, wherein the plate underface 42*b* is destined to extend positively below the plane of the flooring 24 of the snow collecting bucket 16, through lengthwise adjustment of slider 38 by lever means 44, as will be detailed hereinbelow.

Moreover, again as clearly illustrated in FIGS. 3–3*a*, the major portion of shoe 42 is inwardly positioned relative to the snow-loading bucket side wall 20, with only a very small edgewise section thereof protruding laterally outwardly therefrom.

The rear, trailing edge section of shoe plate 42 may also be upturned (upwardly rearwardly inclined), at 42*c*, although this is not as critical as the upturning of the front leading edge 42*a* thereof.

An essential feature of the invention is that the upturned, front, leading edge section 42*a* of each shoe 42 (one adjacent each side wall 20), be positioned slightly frontwardly of the level of the front, leading edge 24*a* of the snow-collecting bucket flooring 24. This is to make sure that, for an incoming ground-anchored road obstacle, the skate 42 will bias the bucket upwardly by slidingly moving over the obstacle, rather than striking it head on as would be the case with the bucket flooring front leading edge 24*a*.

It is understood that, since channel 40 of the shoe supporting frame 36 is inclined e.g. by 30° relative to the horizontal axis of direction of displacement of vehicle 10, lengthwise sliding motion of shaft 38 through channel 40 will adjust the elevation i.e. the relative height of the shoe plate underface 42*b*, concurrently with adjusting the horizontal fore and aft position of the shoe plate leading edge 42*a* relative to the level of the flooring leading edge section 24*a*.

The snow shoe locking means 44 consists of a lever arm 48 having an enlarged, endwise ear plate 50 pivoted by axle 52 to a raised yoke member 54, at the upper, rear section of frame 36. Pivot axle 52 is parallel to channel 40, and positioned upwardly, slightly outwardly therefrom relative to the vertical plane extending through channel 40. Ear plate 50 defines about its lower edge section a number of downwardly-dependent teeth 56 adapted to extend transversely to the lengthwise axis of channel 40. Slider shaft 38 further includes about its upper edge section a plurality of upwardly protruding teeth 58, of a shape to matingly conform by male-female locking engagement with the troughs between the ear plate teeth 56.

Thus, ear 50 is pivotable from a first, operative position shown in FIG. 3, where teeth 56 positively, releasably, lockingly engage into the troughs between selected teeth 58 from a registering section of shaft 38, wherein shaft 38 is locked to frame 36, to a second, inoperative position shown in FIG. 3*a*, where the ear teeth 56 completely clear the troughs between the selected shaft teeth 58, wherein slider 38 is then free to slide through channel 40 for example downwardly under the bias of its own weight. Thus, the setting of the shaft 38 inside its channel 40 will be facilitated, with respect to the adjustment of height of the skate 42, in that, by its own weight, the shaft will settle itself by sliding downwardly along channel 40 until the skate 42 abuts against the ground.

Preferably, in the operative position of locking means ear 50, the lever 48 abuts against the side of frame 36, in a substantially vertical position; it is in this position that the lever will set, by its own weight, when released from its inclined position of FIG. 3*a* after lengthwise adjustment of slider 38 has been obtained.

Bracket means 60 are provided to releasably, lockingly retain lever 48 in its operative position of FIG. 3, when the vehicle 10 is in motion. Bracket means 60 consists of a yoke member 62, transversely projecting laterally inwardly from the rear section of frame 36, so as to define a mouth 62*a* in the plane of pivotal lever 48. A bolt 64 is engaged into throughbores 66 made in the end portions of the two legs of yoke 62, and screwed in place with a nut 68, to retain within yoke 62 the lever 48 after the latter has fully engaged therein.

The present invention is therefore specifically directed to a pair of shoes 42, each mounted by a shoe mount assembly to a corresponding one of the two side edge walls of a front, snow-collecting, worm-screw carrying bucket from an automotive snow-plow 10. The position of the shoes can be adjusted both about fore and aft, and elevational axes, by the sliding motion of the shaft 38 inside the channel 40, which shaft can be thereafter locked in position by bracket means 48.

The shoe or skate means 34 is substantially completely concealed rearwardly of the bucket 16, and substantially inwardly offset relative to the adjacent bucket side wall 20, wherein it will not hamper free sliding through-motion of the bucket sidewisely against the thus formed, snow-cleared channel, opposite, vertical snow walls, when the vehicle 10 frontwardly engages a snow bank of a height exceeding that of the bucket 16. Furthermore, the shoe or skate means 34 will not only slightly raise the bucket 16, but also, when the vehicle 10 rolls on a road, the shoe means 34 will positively prevent the front leading edge 24*a* of the bucket flooring from striking raised rigid projections on a high-crowned road, since the skate means 34, being frontwardly positioned relative to leading edge 24*a*, will lift the whole bucket 16 before the edge section 24*a* becomes struck. It is understood that, without such skate means 34, not only could the whole bottom wall 24 of the bucket be considerably damaged by such an impact following engagement with a pothole, icepack, high crown, and the like obstacle, but it could also positively and brutally stop the whole vehicle 10, a dangerous perspective both for the integrity of the vehicle structure and more importantly, for the safety of the crew in the vehicle cabin.

Preferably, a roll pin 70 is added to the upper end of the slidable shaft 38 to extend transversely therethrough and project outwardly therefrom, so as to prevent accidental release of the shaft 38 (and therefore of the skate 34) from channel 40 when the bucket is lifted well above its operative, ground-engaging position.

Therefore, the constituting elements of skate means 34 should be made from a sturdy yet lightweight, rigid, weather resistant, rustproof material, e.g. a suitable metallic (e.g. aluminum) alloy. Attention should be brought to the skate 42, which should be tempered stainless steel or similar grade material.

Slider shaft 38 and the channel into which shaft 38 is lodged may have various cross-sectional shapes, including triangular, quadrangular, or other polygonal shapes, provided they prevent rotation of the shaft inside its channel 40, since such an outcome would render latch means 48 inoperative because teeth 56 and 58 could then be allowed to undesirably disengage one another.

We claim:

1. In combination, an automotive snowplow vehicle having a front, snow-collecting bucket destined to collect snow and ice upon forward motion of the vehicle on a road pavement, said vehicle destined to have additional means for further crushing snow and ice within said bucket, for gathering the crushed snow and ice and for ejecting same laterally away from the road through a pivotable chute; said bucket defining a large, frontwardly-opened casing having top, bottom, rear and substantially vertical side walls bounding a large, front mouth, and a pair of skate mount assemblies each mounted to a bottom, rear end section of a corresponding one of the two said side walls of the bucket casing; each said skate mount assembly defining a substantially straight skate member integrally mounted to said bucket and defining a smooth, substantially horizontal underface designed to slidingly horizontally engage said road, the front, leading edge section of said skate member being upwardly forwardly inclined, said bucket bottom wall or floor defining a front leading edge being slightly rearwardly offset relative to the level of said skate member upturned front edge section; each said skate mount assembly being positioned substantially interiorly of the vertical plane passing through the corresponding bucket side wall; further including adjustment means for concurrently adjusting both the elevation of said skate member relative to said bucket flooring and the fore-and-aft position of said skate member relative to said bucket flooring front leading edge, wherein forward displacement of the skate member position is effected concurrently with downward displacement thereof, or rearward displacement of the skate member position is effected concurrently with upward displacement thereof; wherein each said skate mount assembly further includes a frame member, integrally mounted to said corresponding bucket side wall, said frame member defining an open-ended rearwardly, upwardly-inclined channel extending therethrough, an elongated slider shaft slidably engaged into said channel and endwisely integrally carrying said skate member at its bottom end at an acute angle, and locking means to fixedly releasably secure said slider shaft to said frame member in a selected lengthwise position within said channel; and wherein said channel and said slider shaft are cross-sectionally polygonal, said skate mount assembly further defining a free rearward section, clearing said bucket, and wherein said locking means includes:

a) a number of first teeth, upwardly projecting from the rearward section of said slider shaft;

b) a lever arm, pivotally mounted at its top end by a pivot ear to said skate mount frame, said pivot ear defining a pivotal axis extending parallel to said channel and a number of few second teeth downwardly depending therefrom, wherein said lever arm is pivotable between a first operative position, in which said first teeth matingly engage into the troughs between said second teeth, thereby positively preventing sliding motion of said shaft within said channel and thus anchoring thereof therewithin, and a second inoperative position, in which said first and second teeth are clearly spaced from each other, thereby enabling free sliding motion of said shaft through said channel.

2. A snow plow vehicle as defined in claim 1, wherein said lever arm is vertically extending in its said operative position where said first teeth engage the trough between said second teeth.

3. A snow plow vehicle as defined in claim 1, further including bracket means, to releasably anchor said lever arm in its said operative position.

* * * * *